US006684777B2

(12) United States Patent
Marmin

(10) Patent No.: US 6,684,777 B2
(45) Date of Patent: Feb. 3, 2004

(54) DEVICE FOR THE CONTROL OF BLOWING AIR, TURNER BAR ASSEMBLY, AND PRINTING MACHINE

(75) Inventor: Jean-Claude Marmin, Estrées-Saint-Denis (FR)

(73) Assignee: Heidelberger Druckmaschinen AG, Heidelberg (DE)

( * ) Notice: Subject to any disclaimer, the term of this patent is extended or adjusted under 35 U.S.C. 154(b) by 22 days.

(21) Appl. No.: 10/078,984

(22) Filed: Feb. 20, 2002

(65) Prior Publication Data

US 2002/0112623 A1 Aug. 22, 2002

(30) Foreign Application Priority Data

Feb. 20, 2001 (DE) ..... 101 07 857

(51) Int. Cl.[7] ..... B41F 13/06; B65H 23/32

(52) U.S. Cl. ..... 101/228; 242/615.12

(58) Field of Search ..... 101/228; 226/10, 226/97.4, 196.1; 242/615.21, 615.12; 251/331, 30.03, 28, 117

(56) References Cited

U.S. PATENT DOCUMENTS

| | | | | |
|---|---|---|---|---|
| 2,753,181 A | * | 7/1956 | Anander | 226/95 |
| 4,453,465 A | | 6/1984 | Heller et al. | |
| 4,718,629 A | * | 1/1988 | Block et al. | 248/363 |
| 4,739,770 A | * | 4/1988 | Stephens et al. | 600/488 |
| 5,090,393 A | * | 2/1992 | Holch | 123/574 |
| 5,273,201 A | * | 12/1993 | Hambrecht | 242/615.12 |
| 5,452,834 A | | 9/1995 | Mariotti et al. | |
| 5,797,531 A | | 8/1998 | Marmin | |

FOREIGN PATENT DOCUMENTS

| | | |
|---|---|---|
| DE | 43 35 051 C2 | 4/1994 |
| DE | 196 37 674 A1 | 4/1997 |
| DE | 198 12 360 A1 | 9/1999 |
| EP | 0 092 658 B1 | 5/1985 |
| EP | 0 706 003 B1 | 6/2000 |

* cited by examiner

*Primary Examiner*—Andrew H. Hirshfeld
*Assistant Examiner*—Leo T. Hinze
(74) *Attorney, Agent, or Firm*—Laurence A. Greenberg; Werner H. Stemer; Ralph E. Locher

(57) ABSTRACT

The device for the control of blowing air is connected to a compressed-air source and it includes at least one outflow orifice. The device has a valve element which is moveable into a first position in which blowing air flows from the compressed-air source at least through a first duct to the outflow orifice and which is moveable into a second position in which blowing air flows from the compressed-air source at least through a second duct to the outflow orifice. A volume flow through the second duct is greater than a volume flow through the first duct. The device is formed as a basic body which is constructed in such a way that a plurality of such basic bodies can be assembled to form a blowing-air body, such as a turner bar in a printing machine.

19 Claims, 6 Drawing Sheets

DEVICE FOR THE CONTROL OF BLOWING AIR, TURNER BAR ASSEMBLY, AND PRINTING MACHINE

BACKGROUND OF THE INVENTION

Field of the Invention

The present invention relates to a device for the control of blowing air, in particular in a web-fed rotary printing machine or in a turner bar of a web-fed rotary printing machine. The device is connected to a compressed-air source and is formed with at least one outflow orifice, and the device has a valve element which is moveable into a first position in which blowing air flows from the compressed-air source at least through a first duct to the outflow orifice and which is moveable into a second position in which blowing air flows from the compressed-air source at least through a second duct to the outflow orifice. A volume flow through the second duct is thereby greater than a volume flow through the first duct.

The invention relates, furthermore, to a turner bar, in particular for deflecting a printed material web in a web-fed rotary printing machine.

My earlier U.S. Pat. No. 5,797,531 (see German publication DE 196 37 674 A1) discloses a differential-pressure turning-bar arrangement, by means of which a printed material web, for example a paper web, is deflected from a run-in movement direction to a run-out movement direction, the run-out movement direction being determined by the angle of arrangement of the turner bar to the run-in movement direction and by the looping angle of the material web in relation to the turner bar. In order to prevent the printing ink from being deposited from the freshly printed and, where appropriate, dried material web onto the surface, for example the casing, of the turner bar, the turner bar is connected to a compressed-air supply and is provided with air outlet orifices, out of which blowing air is blown into the region between the turning-bar casing and the material web looping around the turner bar. This results, between the material web and the turning-bar casing, in the formation of an air cushion, on which the material web is moved contactlessly over the turning-bar casing, so that a smudging of printing ink on the looped-around surface region of the turner bar is prevented. The turner bar, has, furthermore, inside it, closing elements, with which the air outlet orifices can be partially closed. The closing elements are provided with a bore, through which blowing air can emerge, even when the air outlet orifice is in the closed state, and are moveable in a guide. When an outlet orifice is covered by a material web, the air stream through the bore is obstructed in the closing element, and, as a result of the dynamic pressure which builds up above the closing element, the latter is moved in the guide into a position in which the closing element releases the air outlet orifice. Blowing air can then flow via a bypass from the compressed-air supply to the air outlet orifice and a sufficiently stable and load-bearing air cushion can form under the material web surrounding the turner bar. However, those air outlet orifices of the turner bar which are not covered by the material web continue to remain closed by the closing element, so that only a reduced air stream which flows through the respective bore in the respective closing element passes outward from them.

What is achieved by the arrangement described is that the air outlet orifices not covered by the material web are acted upon only by reduced blowing air. As a result, the compressed-air supply can have, overall, smaller dimensioning. Furthermore, by the blowing air being controlled automatically by means of the closing elements, complicated remotely controllable components and the laborious climbing to the turning-bar superstructure for setting or changing over the blowing-air orifices are unnecessary.

A disadvantage of my older assembly, however, is that it is relatively difficult to mount and maintain and, moreover, that a turning-bar configuration has to be manufactured individually for each predetermined length of the latter. The disadvantages mentioned lead, furthermore, to increased investment and maintenance or repair costs.

SUMMARY OF THE INVENTION

It is accordingly an object of the invention to provide a blowing air control device, which overcomes the above-mentioned disadvantages of the heretofore-known devices and methods of this general type. It is a further object of the present invention to provide a turner bar which, while avoiding the above-mentioned disadvantages of the prior art, deflects a material web accurately and without any damage.

With the foregoing and other objects in view there is provided, in accordance with the invention, a device for the control of blowing air, comprising:

- a basic body formed with an inlet for connection to a compressed-air source and with at least one outflow orifice;
- a valve element moveably disposed between a first position in which blowing air flows from the compressed-air source at least through a first duct to the outflow orifice and a second position in which blowing air flows from the compressed-air source at least through a second duct to the outflow orifice, wherein a volume flow through the second duct is greater than a volume flow through the first duct; and
- the basic body being constructed for assembly into a blowing-air body formed of a plurality of the basic bodies.

With the above and other objects in view there is also provided, in accordance with the invention, a turner bar assembly formed with a plurality of modules each including at least one device for the control of blowing air as outlined above and together forming a turner bar. The turner bar is specifically suitable for use in a printing machine, such as a web-fed rotary printing machine.

In other words, a device for the control of blowing air is provided, the device being connected to a compressed-air source and comprising at least one outflow orifice or air outlet orifice, and the device having a valve element which is moveable into a first position in which blowing air flows from the compressed-air source at least through a first duct to the outflow orifice and which is moveable into a second position in which blowing air flows from the compressed-air source at least through a second duct to the outflow orifice, the volume flow through the second duct being greater than the volume flow through the first duct, is distinguished in that the device has a basic body which is designed in such a way that a plurality of such basic bodies can be assembled to form a blowing-air body, in particular a turner bar.

The device according to the invention has, in the first instance, the advantage that it is constructed from two basic elements to be produced or procured cost-effectively, the, for example, essentially disk-shaped valve element and the basic body, so that both the mounting of the device and the subsequent maintenance or repair of the device become possible at low cost and with little labor. There may be provision, moreover, for the basic body to be made multipart and, for example, capable of being assembled.

A further advantage of the device according to the invention arises from the fact that the basic body is designed in such a way that a plurality of such basic bodies can be assembled to form a blowing-air body. It is thereby possible, for example, to construct a turner bar from devices according to the invention with a minimal use of material and minimal labor, as it were in a modular design, and advantageously to provide the required length of the turner bar by the addition or omission of individual devices.

A preferably disk-shaped or flat configuration of the valve element affords the advantage, furthermore, that the, for example, essentially cylindrical basic body can have a small (cylinder) height, so that, with the same predetermined length of, for example, a turner bar, a larger number of devices according to the invention can be assembled to form the turner bar, with the result that the turner bar comprises a larger number of outflow orifices and the sectional control of blowing air with increased spatial definition becomes possible.

Furthermore, the advantage of the prior art that the dimensioning of the compressed-air supply can be reduced is further enhanced by the device according to the invention, since, due to the use of the above-described basic bodies, the construction of the blowing-air bodies varies and can be adapted to the prevailing requirements of the material-web transport.

It is also possible, furthermore, to make the valve element deformable and to deform the valve element from the first position to the second position, and vice versa.

In a further embodiment of the present invention, the valve element may advantageously be designed as a diaphragm valve, plate valve or disk valve. It is possible, for example, to manufacture the diaphragm valve preferably from an elastomeric material or an elastomeric mixture, a disk, for example a plastic or metal disk, being capable of being embedded into the elastomer or of being applied or adhesively bonded to the elastomer. It is possible, moreover, for the diaphragm valve to have an airtight edge region which is designed as a concertina and can be received, for example, in a groove of the basic body.

In a further version according to the invention of the device, there may be provision for the basic body to have a first chamber with a seat for the valve element, the chamber being connected to the outflow orifice by means of the first duct, and for the valve element to be moved into the second position when the air pressure in the first chamber is increased and to be moved automatically into the first position when the air pressure in the first chamber is reduced. It is also conceivable for the basic body to have a second chamber which is connected to the atmosphere by means of a third duct in such a way that an unimpeded movement of the valve element becomes possible by pressure equalization.

It may be remarked here, that the term "chamber" designates any kind of recess or space in the basic body, even when the chamber is not closed off by walls on all sides. Thus, for example, there may be provision for the first and the second chamber each to be open on one side, to adjoin one another in each case with this open side and to be separated from one another on this side by the valve element, for example, the diaphragm valve.

It may also be remarked, here, that the term "duct" designates any connection made in the basic body, for example between orifices of the basic body, chambers formed in the basic body or the outflow orifice and a chamber, while a duct may also be open with one longitudinal side, for example, to a chamber.

It is also possible, furthermore, to design the ducts as lines, in which case, for example, hoses, in particular rubber hoses or tubes, may be provided.

It is also possible for the basic body to be of essentially cylindrical or disk-shaped design, the at least one outflow orifice being arranged in the edge region of the cylinder or of the disk, and for the disk-shaped valve element to be oriented preferably essentially parallel to the basic body.

This special type of arrangement of the basic body and disk-shaped valve element advantageously makes it possible to provide a device with a very small construction height and thereby assemble a large number of such devices, which may also be designated as modules or members, to form a turner bar of predetermined length.

In a further refinement of the device according to the invention, the basic body may have, on one side, a centering and, on another, opposite side, a receptacle for a centering of a further basic body.

What is advantageously achieved thereby is that the individual basic bodies can be assembled accurately and simply.

Furthermore, the basic body may have a compressed-air entry on one side and a compressed-air exit on another side, the compressed-air exit being connected to the compressed-air entry of the basic body, and the compressed-air exit being capable of being connected to, in particular plugged together with, the compressed-air entry of a further basic body.

By virtue of this special type of construction of the basic body, the basic body of a device can advantageously be connected to the compressed-air source, for example via a hose line, while the further basic bodies are not connected directly to the compressed-air source, but are supplied with compressed air by the basic body in each case arranged adjacently in the direction of the compressed-air source. The individual basic bodies lined up directly or indirectly with one another thus advantageously form a compressed-air line.

In a further embodiment of the invention, there may be provision, during the movement of the valve element, for a plurality of ducts to be released, for example in succession, in which case the volume flow through these ducts may be in any desired relation to the volume flow through the first duct, so that the overall volume flow is greater than the volume flow through the first duct.

A turner bar according to the invention, in particular for deflecting a printed material web in a web-fed rotary printing machine, is distinguished in that the turner bar is constructed at least partially from modules, in particular from structurally identical modules, which each comprise at least one device of the type described above.

Turner bars according to the invention of modular or membered design can be manufactured simply and cost-effectively and, furthermore, advantageously have length and construction variability. A variable construction of one or more turner bars can be achieved, according to the invention, in that differently configured turning-bar modules or turning-bar members are used for constructing the turner bars. It is also conceivable, furthermore, to insert between the individual modules intermediate members which do not have a device for the control of blowing air and, for example, serve merely as spacers between individual devices according to the invention and transfer the blowing air from one device to the next. Moreover, the basic bodies of the individual modules, the basic bodies also being capable of constituting the modules themselves, may have a variable height and also a variable number of air outlet orifices.

In a further refinement of the invention, a turner bar may comprise a plurality of air outflow orifices arranged essentially parallel to the longitudinal axis of the turner bar. Those air outflow orifices which are covered by a material web are in this case acted upon by a large volume flow of blowing air by means of a respective device for the control of blowing air, whereas those air outflow orifices which are not covered by a material web are acted upon by a small volume flow of blowing air from the respective device for the control of blowing air.

It is possible, moreover, for the modules of a turner bar according to the invention to be surrounded at least partially by a turning-bar casing which may have casing holes which are in alignment with the air outflow orifices of the modules.

The turning-bar casing can thus advantageously stabilize the lined-up modules and, for example, be manufactured from a material which additionally prevents printing ink from being deposited on the surface of the turner bar and/or is easy to clean.

A printing machine according to the invention, in particular a web-fed rotary printing machine, a folder according to the invention or a folder superstructure according to the invention are distinguished by a device or a turner bar of the type described above.

Other features which are considered as characteristic for the invention are set forth in the appended claims.

Although the invention is illustrated and described herein as embodied in a device for the control of blowing air, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
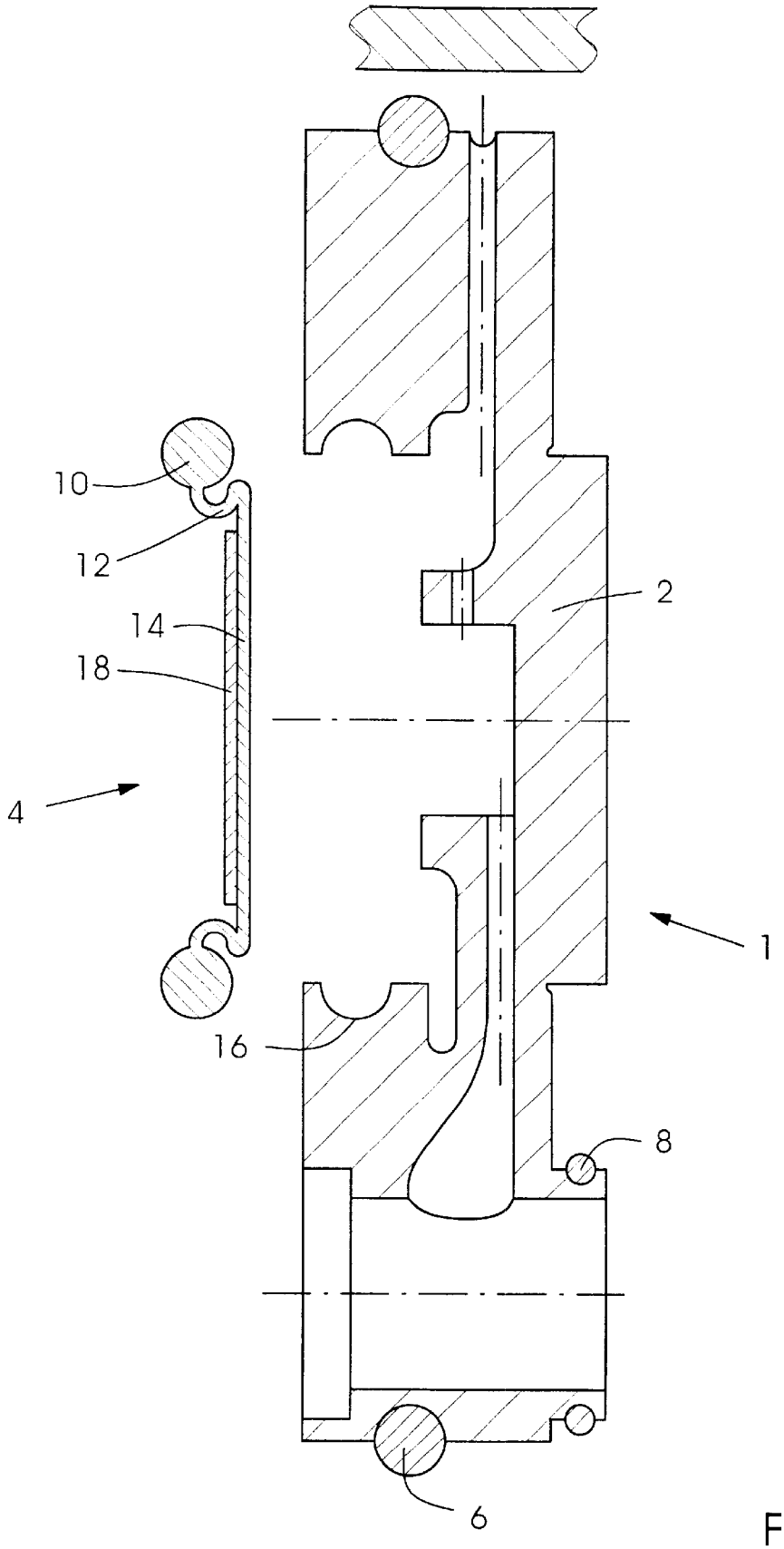
FIG. 1 shows a sectional view of a device according to the invention with a valve element and with a basic body.
Figure 2:
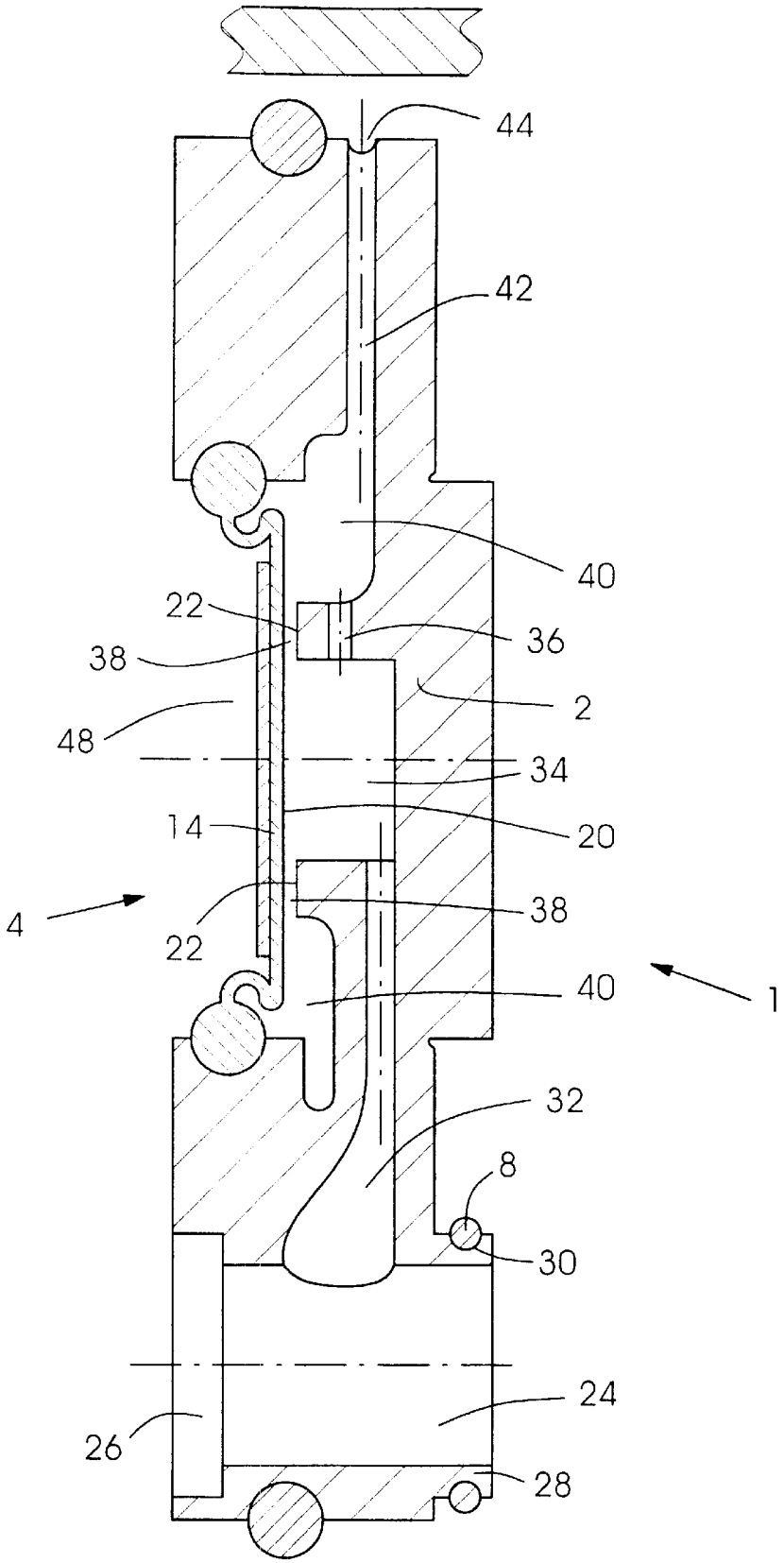
FIG. 2 shows a sectional view of a device according to the invention with an inserted valve element.

Referring now to the figures of the drawing in detail and first, particularly, to FIGS. 1 and 2 thereof, there is shown a device for the control of blowing air 1, which can be used, for example, in a turner bar (also referred to as a turning bar) of a web-fed rotary printing machine. The device 1 comprises a basic body 2, a valve element 4, a ring 6, and a sealing ring 8. The valve element 4 is shown in FIG. 1 next to the basic body 2 for the sake of clarity, but, when the device is in operation, is in the installed or inserted state within the basic body 2, as may be gathered, for example, from FIG. 2. The valve element 4 preferably comprises an annular edge region 10, an intermediate region 12 designed as a bellows, and a substantially disk-shaped diaphragm region 14. At least the intermediate region and the diaphragm region can be produced from an elastomeric material or from an elastomeric mixture, for example rubber or caoutchouc. The edge region 10, which serves for retaining the valve element 4 and can be inserted into a groove 16 of the basic body 2, may likewise be formed from an elastomeric material, but also, for example, from plastic or metal. It is possible, furthermore, to produce the valve element 4 or the edge region, intermediate region and diaphragm region as a single work piece or assemble it from a plurality of individual work pieces. The diaphragm region 14 of the valve element 4 may also be reinforced by a disk 18 and its valve action improved, and it is possible to apply, for example adhesively bond, the disk 18 to the diaphragm region 14, partially embed the disk 18 into the diaphragm region 14 or incorporate the disk 18 completely into the diaphragm region 14. In this case, the disk 18 may be manufactured from various materials, such as, for example, plastic or metal. The edge region 10 of the valve element 4 forms, together with the groove 16 of the basic body 2, an airtight closure.

FIG. 2 shows the basic body 2 of the device for the control of blowing air, with the valve element 4 inserted. The diaphragm region 14 is in a position in which it is not in touching contact on the diaphragm surface 20 with an annular seat 22, formed in the basic body 2, for the valve element 4.

Figure 3:
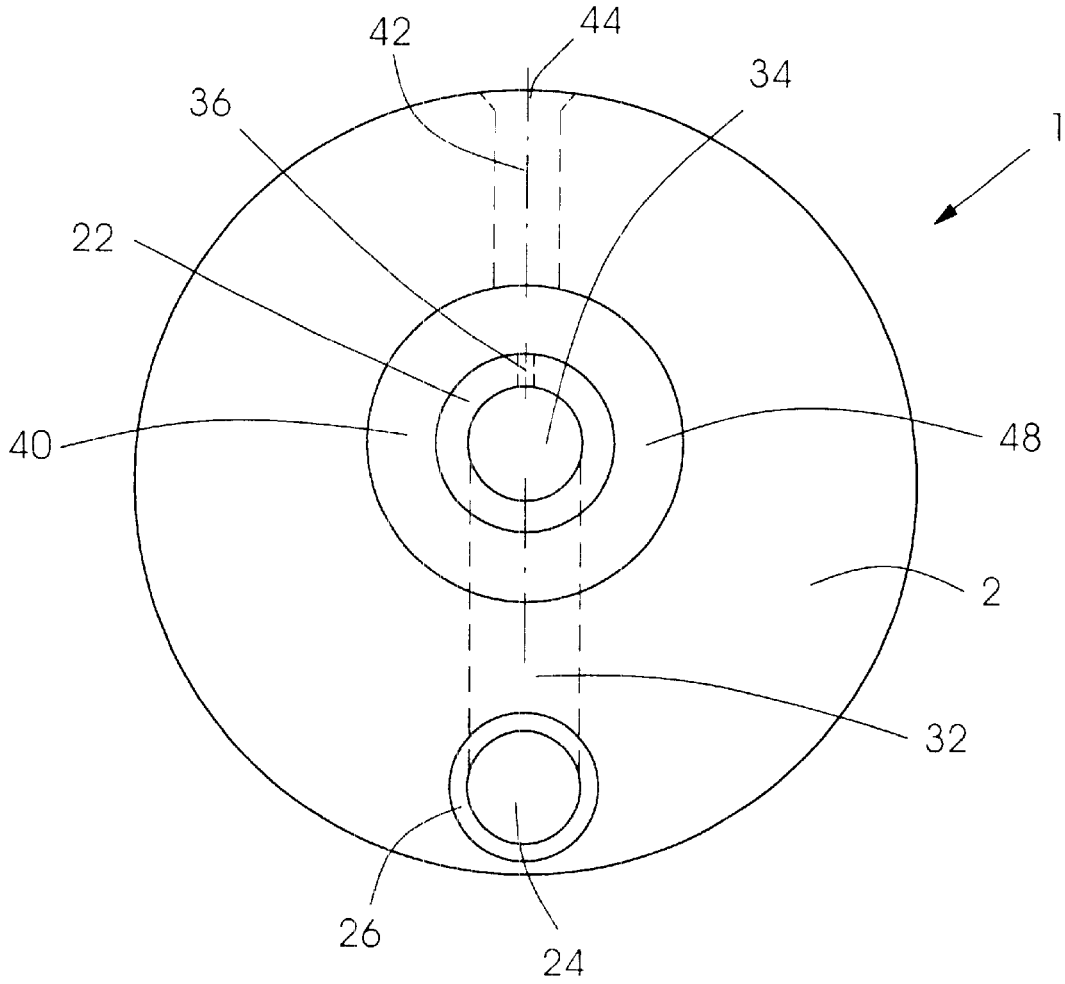
FIG. 3 shows a top view of a device according to the invention.

The various regions, chambers and ducts of the basic body will be described in more detail below. The basic body 2 has a compressed-air feed duct 24 which, as may also be gathered from FIG. 3, is configured as a hole passing through the basic body 2 or else as a bore. As may be seen from FIG. 4, a plurality of devices 1 according to the invention may be lined up with one another and thus be used for the construction of, for example, a turner bar. It may be gathered again from FIG. 2 that, for this purpose, the basic body 2 comprises a recess 26, which may also be designated as a compressed-air entry, and a projection 28, which may also be designated as a compressed-air exit and which has a groove 30 for receiving the sealing ring 8. The compressed-air entry 26 on one side of the basic body 2 and the compressed-air exit 28 on the other side of the basic body 2 are worked in such a way that, when a plurality of basic bodies 2 are assembled, in each case the compressed-air exit 28 of a preceding basic body can be inserted, for example snapped or plugged, into the compressed-air entry 26 of a following basic body.

Compressed air from a non-illustrated compressed-air source connected to the compressed-air entry 26 flows into the compressed-air feed duct and from there can flow, on the one hand, into the compressed-air feed duct 24 of a following device 1 or into a duct 32, designated below as a fourth duct. The applied compressed air, via the fourth duct 32, reaches a first chamber 34 which is partially delimited by the annular seat 22 of the diaphragm surface 20. The compressed air can continue to pass from the first chamber 34 through a first duct 36 or through a second duct 38 in the form of an annular disk, formed between the seat 22 and the diaphragm surface 20, into a third chamber 40 or an outflow space and, from there, through a fifth duct 42 to an outflow orifice 44 formed in the periphery or jacket of the basic body 2.

The first duct 36 may thereby be designed, for example, as a bore of small diameter in the annular seat 22 of the basic body 2, so that the volume flow through the second duct 38 is greater than the volume flow through the first duct 36. By volume flow ($\dot{V}$) is meant the (gas) volume V flowing per unit of time t: $\dot{V}=V/t$.

It can also be seen clearly in FIG. 2 that the valve element 4 separates the first chamber 34 from a second chamber 48 which is connected, for example by way of a non-illustrated duct, in the basic body 2 of the device 1, to a circumferential orifice, likewise not illustrated, of the basic body 2, with the result that pressure equalization in the second chamber 48 with respect to atmospheric pressure becomes possible.

FIG. 3 shows a top view of the device 1, in which the basic body 2, the compressed-air feed duct 24, the recess 26, the fourth duct 32, the first chamber 34, the seat 22, the third chamber 40, the fifth duct 42 and the outflow orifice 44 can be seen. Furthermore, the first duct 36 in the annular seat 22 is illustrated. A diaphragm can be inserted into the region of the second chamber 48 and close off, airtight, the circular first chamber 34 from the annular third chamber 40 by contact with the annular seat 22, in which case compressed air can pass only through the first duct 36 with a small volume flow from a compressed-air supply to the outflow orifice 44.

Figure 4:
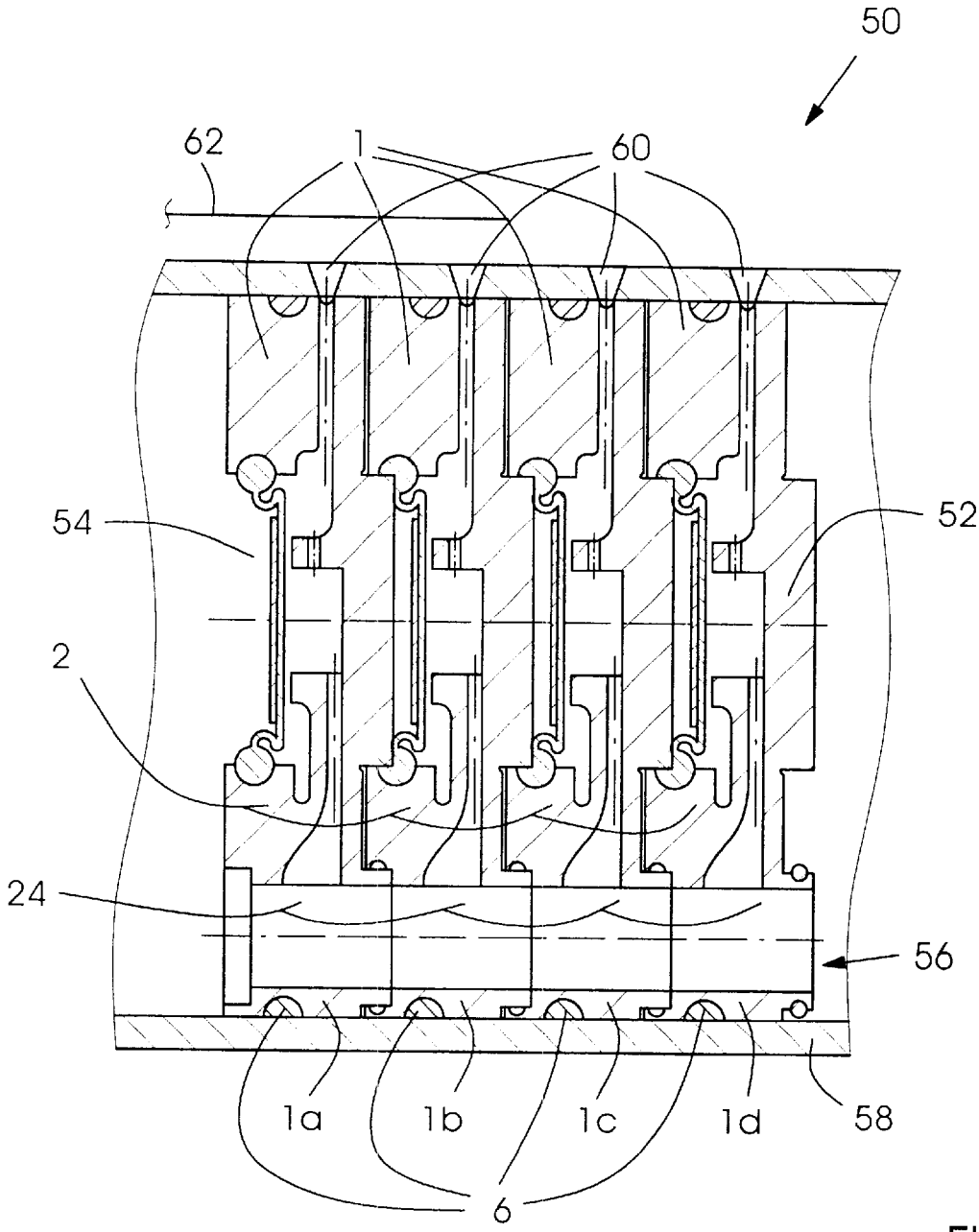
FIG. 4 shows a sectional view of a plurality of devices according to the invention joined to one another or a sectional view of a turner bar according to the invention.

FIG. 4 shows, furthermore, how separate devices for the control of blowing air can be lined up with one another, in order to construct a turner bar 50 or another blowing-air body, as it were, in a modular design. Four devices 1*a,* 1*b,* 1*c* and 1*d* are shown, which each have an essentially disk-shaped basic body 2 and, by being assembled, result in the cylindrical blowing-air body. For this purpose, each basic body 2 has, on one side, a centering 52 which can be assembled together with a receptacle for a centering 54 on the other side of a further basic body 2, for example by the centering 52 being plugged or snapped into the receptacle for a centering 54. When the devices 1 are assembled, the compressed-air feed ducts 24 are likewise assembled to form a common compressed-air duct 56, in that, in each case, a compressed-air exit of a preceding device, for example the device 1*a,* is assembled together with the compressed-air entry of a following device, for example the device 1*b*. In this case, there may be provision for connecting the compressed-air entry of a first device 1 of a row of devices 1, for example via a compressed-air hole, not illustrated, to a compressed-air source, likewise not illustrated, and for closing, airtight, the compressed-air exit of a last device 1 of a row of devices 1. In a further refinement of the invention, the arrangement of the centering 52, of the receptacle for a centering 54, of the compressed-air entry 26 and of the compressed-air exit 28 may also in each case be selected on the other side to that illustrated above.

The devices 1 have, furthermore, in each case rings 6, by means of which the individual devices are arranged within a blowing-air body casing 58 which may completely or partially surround the individual devices. The ring 6 may in this case be received in a circumferential groove of the basic body 2. The casing 58 has orifices or casing holes 60, with which the air outlet orifices 44 of the individual devices 1 are arranged in alignment, so that blowing air can be blown from the orifices 60 of the turner bar 50, for example, onto a material web 62 partially looping around the turner bar 50.

Figure 5:
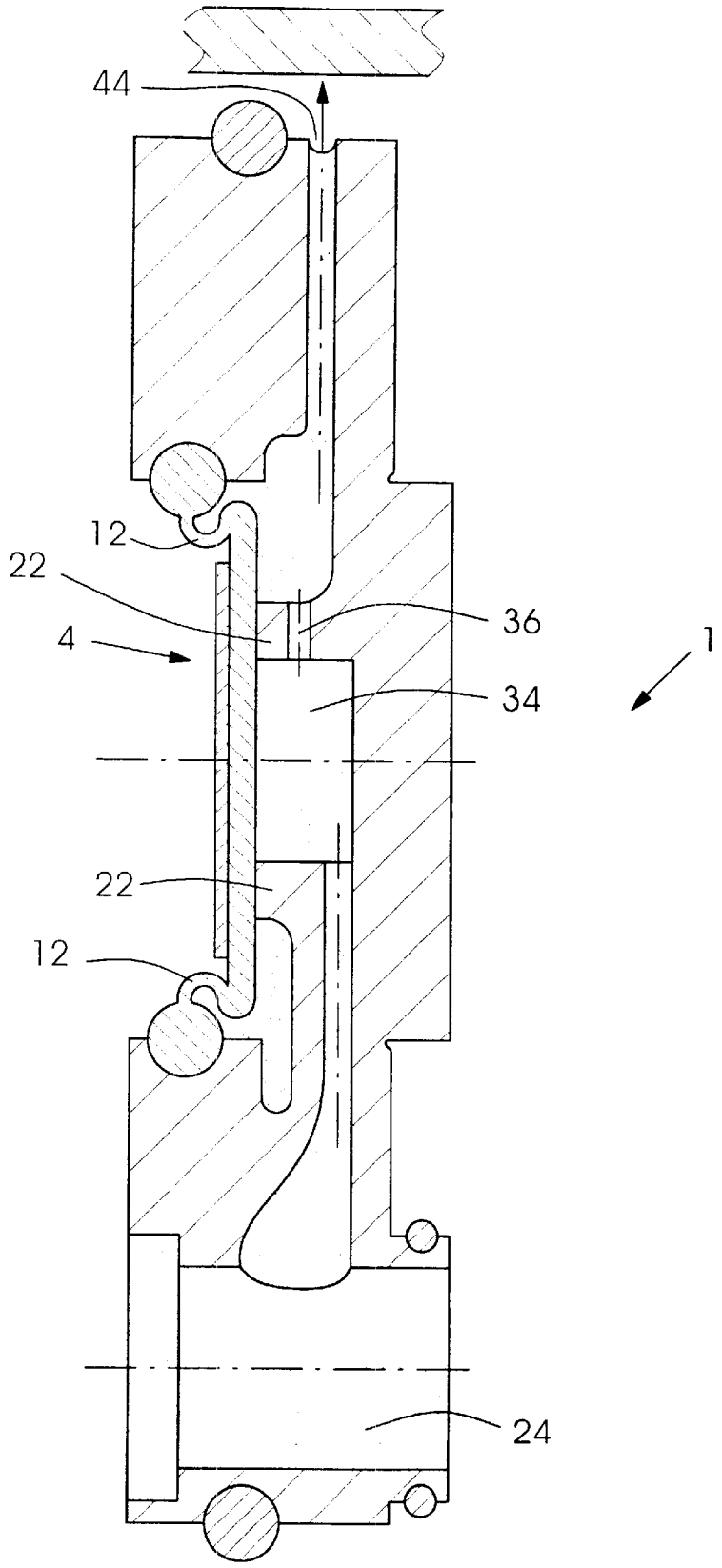
FIG. 5 shows a sectional view of a device according to the invention, with the valve element in a first position.
Figure 6:
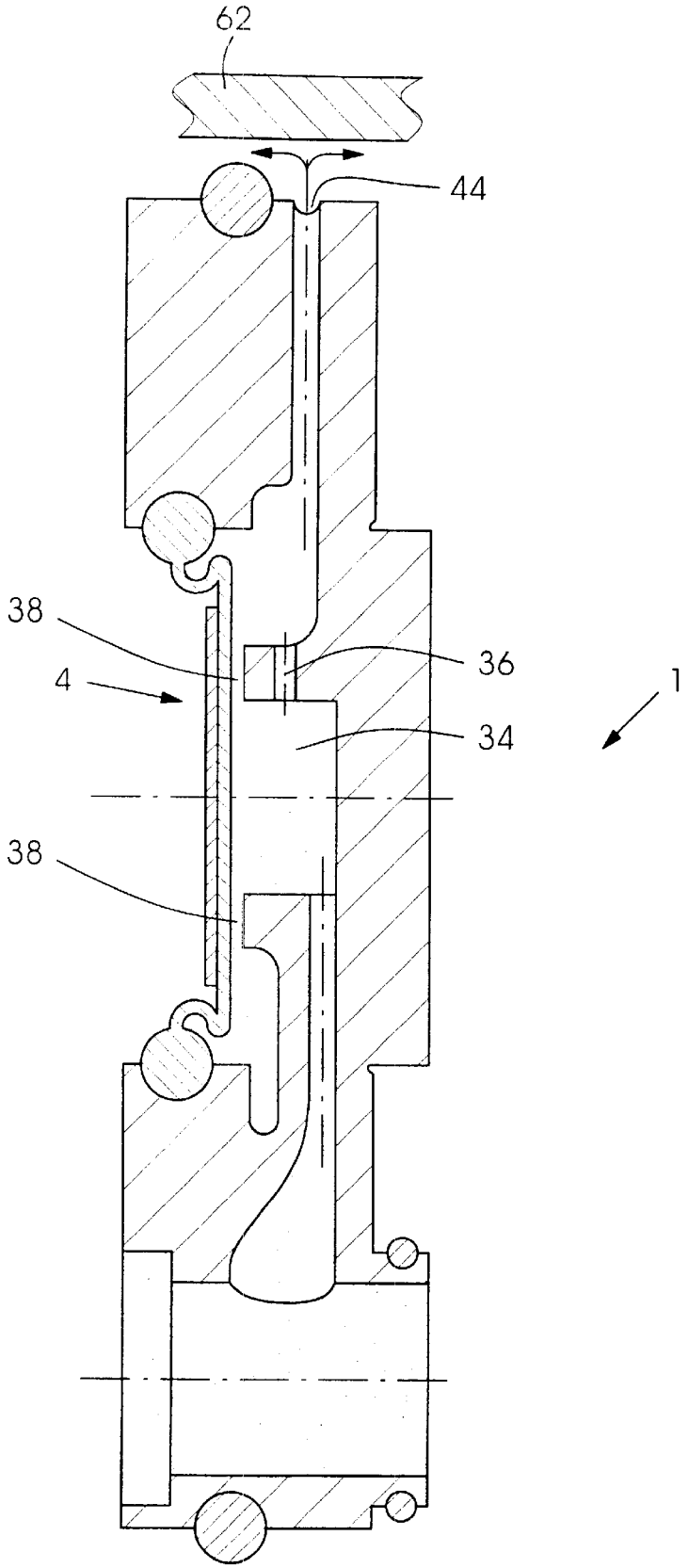
FIG. 6 shows a sectional view of a device according to the invention, with the valve element in a second position.

The functioning of a device 1 according to the invention is explained with reference to FIGS. 5 and 6. FIG. 5 shows, in this case, the device 1 in the closed or tight-closing state, that is to say the valve element 4 is in a first position in which blowing air passes from a compressed-air source, not illustrated, through the first duct 36 to the outflow orifice 44, whereas FIG. 6 shows the device 1 in the open state, that is to say the valve element 4 is in a second position in which blowing air passes from the compressed-air source at least through the second duct 38 to the outflow orifice 44. The valve element is illustrated in the figures, by way of example, as closing against the air stream.

Numerical examples set out below will aid in a better understanding of the functionality of the system. The numerical values are exemplary only. In the closed state, a pressure corresponding to a pressure force of 1.962 N prevails in the compressed-air feed duct 24 and a pressure corresponding to a pressure force of 1.540 N prevails in the first chamber 34. However, the pressure prevailing in the first chamber 34 cannot lift off the diaphragm 4 from the seat 22, since the diaphragm is pressed with a counterpressure corresponding to a pressure force of 4.905 N onto the annular surface of the seat 22 by the intermediate region 12 designed as a belows or concertina. The compressed air therefore can leave the first chamber 34 only through the first duct 36 and arrive at the outflow orifice 34. Since only a small volume flow is possible through the first duct 36, however, only a little blowing air is expelled through the outflow orifice 44 in the closed state. However, as soon as a material web 62 is located above the outflow orifice 44, that is to say obstructs the air stream of the closed state, there is an increase in the pressure in the first chamber 34 to a pressure corresponding to a pressure force of 13.862 N, so that the diaphragm, which continues to be pressed against the seat 22 with a pressure corresponding to a pressure force of 4.905 N, is lifted off from the seat 22, with the result that the second duct 38 is released. Through this, however, it is possible to have a blowing-air flow with a higher volume flow than through the first duct 36, so that, in the open state according to FIG. 6, blowing air flows out of the outflow orifice 44 with a higher volume flow than in the above-described closed state according to FIG. 5.

By means of the device according to the invention for the control of blowing air 1, it is thus possible for blowing air with a high volume flow to act automatically upon only those outflow orifices 44 which are covered by a material web, for example a printed paper web. Those devices 1 which are located, for example, laterally of the moved material web expel only blowing air with a low volume flow, so that the blowing-air supply can, overall, have lower dimensioning.

The terms "connectable", "connect" and "flow from/to" with regard to chambers, ducts and outflow orifices are to be understood in the application as meaning that there can be a direct connection, but also an indirect connection, for example via further chambers and ducts.

I claim:

1. A device for the control of blowing air, comprising:

a basic body having a first side formed with a compressed-air entry for connection to a compressed-air source, a second side formed with a compressed-air exit having a connector to said compressed-air entry, and at least one outflow orifice separate from said compressed-air exit;

a valve element moveably disposed between a first position in which blowing air flows from the compressed-air source at least through a first duct to said outflow orifice and a second position in which blowing air flows from the compressed-air source at least through a second duct to said outflow orifice, wherein a volume flow through said second duct is greater than a volume flow through the first duct; and said basic body being constructed for a line-up assembly of individual basic bodies, said line-up assembly having a compressed-air line, said connector of said compressed-air exit to said compressed-air entry forming a section of said compressed-air line.

2. The device according to claim 1, wherein said basic body is constructed for assembly into one of the group consisting of a blow-air body and a turner bar.

3. The device according to claim 1, wherein said valve element is a diaphragm valve with a disk and with an airtight edge region forming a bellows, and said basic body is formed with a groove for receiving said diaphragm valve.

4. The device according to claim 3, wherein said diaphragm valve is formed of elastomeric material.

5. The device according to claim 1, wherein said basic body has a first chamber formed therein with a seat for said valve element, said first chamber communicates with said outflow orifice by way of the first duct, said valve element is moved into the second position when the air pressure in the first chamber is increased and is automatically moved into the first position when the air pressure in said first chamber is reduced, and wherein said basic body has a second chamber formed therein communicating with atmosphere by way of a third duct to enable an unimpeded movement of said valve element.

6. The device according to claim 5, wherein said basic body has a compressed-air feed duct formed therein communicating with the compressed-air source, and a fourth duct connecting said first chamber with said compressed-air feed duct.

7. The device according to claim 1, wherein said basic body is substantially cylindrical, said at least one outflow orifice is arranged in an edge region of the cylinder, and a substantially disk-shaped valve element is oriented substantially parallel to said basic body.

8. The device according to claim 1, wherein said basic body is substantially disk-shaped, said at least one outflow orifice is arranged in an edge region of the disk, and a substantially disk-shaped valve element is oriented substantially parallel to said basic body.

9. The device according to claim 1, wherein said basic body has a first side formed with a centering device and a second side opposite said first side formed with a receptacle for receiving a centering device of a respective adjoining said basic body.

10. The device according to claim 1, wherein said basic body has a first side formed with a compressed-air entry and a second side formed with a compressed-air exit communicating with said compressed-air entry, and said compressed-air exit is configured to be connected to a compressed-air entry of a respective adjoining said basic body.

11. The device according to claim 1, wherein said compressed-air exit is configured to be plugged into said compressed-air entry of the respective adjoining said basic body.

12. A turner bar assembly, comprising a plurality of modules each including at least one device for the control of blowing air according to claim 1 and together forming a turner bar.

13. The turner bar assembly according to claim 12, wherein said plurality of modules together form a turner bar for deflecting a printed material web in a web-fed rotary printing machine.

14. The turner bar assembly according to claim 13, wherein said turner bar is formed with a plurality of air outflow orifices arranged parallel to a longitudinal axis of said turner bar, and wherein air outflow orifices that are covered by a material web are acted upon by blowing air with a relatively high volume flow and air outflow orifices that are not covered by a material web are acted upon by blowing air with a relatively small volume flow.

15. The turner bar assembly according to claim 12, which comprises a turner-bar casing surrounding said modules at least partially, said turning-bar casing having casing holes formed therein in alignment with respective said air outflow orifices of said modules.

16. In combination with a printing machine, a turner bar assembly according to claim 12 disposed in the printing machine.

17. The combination according to claim 16, wherein said printing machine is a web-fed rotary printing machine.

18. In combination with a printing machine, a device for the control of blowing air according to claim 1 disposed in the printing machine.

19. The combination according to claim 18, wherein said printing machine is a web-fed rotary printing machine.

* * * * *